US009679708B2

(12) United States Patent
Benson, IV et al.

(10) Patent No.: US 9,679,708 B2
(45) Date of Patent: Jun. 13, 2017

(54) CIRCUIT INTERRUPTERS WITH MASSES IN CONTACT SPRING ASSEMBLIES

(71) Applicant: S&C Electric Company, Chicago, IL (US)

(72) Inventors: Keith W. Benson, IV, Chicago, IL (US); Henry W. Kowalyshen, Niles, IL (US)

(73) Assignee: S&C Electric Company, Chicago, IL (US)

( * ) Notice: Subject to any disclaimer, the term of this patent is extended or adjusted under 35 U.S.C. 154(b) by 112 days.

(21) Appl. No.: 14/678,038

(22) Filed: Apr. 3, 2015

(65) Prior Publication Data

US 2015/0294807 A1 Oct. 15, 2015

Related U.S. Application Data

(60) Provisional application No. 61/978,378, filed on Apr. 11, 2014.

(51) Int. Cl.

| | |
|---|---|
| ***H01H 3/00*** | (2006.01) |
| ***H01H 3/60*** | (2006.01) |
| ***H01H 33/666*** | (2006.01) |

(52) U.S. Cl.

CPC ..... *H01H 3/001* (2013.01); *H01H 3/60* (2013.01); *H01H 33/666* (2013.01)

(58) Field of Classification Search

CPC ..... H01H 69/02; H01H 71/20; H01H 85/10; H01H 85/12; H01H 1/26; H01H 1/58; H01H 1/5822; H01H 1/62; H01H 2205/002; H01H 2223/002; H01H 2223/038; H01H 2235/01; H01H 33/08; H01H 33/42; H01H 35/34

See application file for complete search history.

(56) References Cited

U.S. PATENT DOCUMENTS

| | | | |
|---|---|---|---|
| 3,564,465 | A | 2/1971 | Harvey |
| 3,898,407 | A | 8/1975 | Hodgson |
| 3,920,941 | A | 11/1975 | Hundstad |

(Continued)

FOREIGN PATENT DOCUMENTS

| | | |
|---|---|---|
| GB | 1589509 | 5/1981 |

OTHER PUBLICATIONS

United States International Searching Authority, International Search Report and Written Opinion for International Application No. PCT/US15/24800 mailed Jul. 16, 2015.

*Primary Examiner* — Truc Nguyen

(74) *Attorney, Agent, or Firm* — Lorenz & Kopf LLP

(57) ABSTRACT

Devices and assemblies are provided for operating circuit interrupters. A circuit interrupter assembly includes a circuit interrupter and a contact spring assembly. The circuit interrupter is located within the housing and includes a moving contact and a stationary contact. Contact spring assembly includes a mass, a plunger, a ferrule, a spring, and a dielectric drive rod. The mass defines an inner bore with a first diameter at a first portion of the mass and a second diameter that is larger than the first diameter at a second portion of the mass. The plunger has a flange portion and a body portion. The flange portion is located within the inner bore at the second portion and has a flange diameter that is larger than the first diameter. The spring is disposed within the inner bore between the plunger and the ferrule.

18 Claims, 4 Drawing Sheets

(56) References Cited

U.S. PATENT DOCUMENTS

| | | | | |
|---|---|---|---|---|
| 4,225,763 | A * | 9/1980 | Barkan | H01H 33/666 218/120 |
| 4,234,771 | A * | 11/1980 | Ohkawa | H01H 3/52 218/139 |
| 5,747,766 | A | 5/1998 | Waino et al. | |
| 5,808,258 | A * | 9/1998 | Luzzi | H01H 33/66207 218/136 |
| 5,912,604 | A | 6/1999 | Harvey et al. | |
| 6,140,894 | A | 10/2000 | Lane | |
| 6,156,989 | A | 12/2000 | Miller et al. | |
| 6,198,062 | B1 | 3/2001 | Mather et al. | |
| 6,362,444 | B1 | 3/2002 | Lee | |
| 6,444,939 | B1 | 9/2002 | Crookston et al. | |
| 6,674,039 | B1 | 1/2004 | Banghard et al. | |
| 7,041,929 | B2 | 5/2006 | Banghard et al. | |
| 7,075,027 | B1 | 7/2006 | Fogle et al. | |
| 7,215,228 | B2 | 5/2007 | Rhein | |
| 2001/0025830 | A1* | 10/2001 | Allard | H01H 1/5822 218/118 |
| 2006/0086694 | A1* | 4/2006 | Benke | H01H 33/666 218/154 |
| 2006/0102594 | A1* | 5/2006 | Kikuchi | H01H 1/0206 218/123 |
| 2007/0108164 | A1* | 5/2007 | Muench | H01H 33/66207 218/118 |
| 2009/0078681 | A1* | 3/2009 | Marchand | H01H 33/6606 218/140 |
| 2009/0218319 | A1* | 9/2009 | Kagawa | H01H 33/6606 218/140 |
| 2016/0049270 | A1* | 2/2016 | Gass | H01H 35/141 200/61.53 |

* cited by examiner

CIRCUIT INTERRUPTERS WITH MASSES IN CONTACT SPRING ASSEMBLIES

CROSS-REFERENCE TO RELATED APPLICATION

This application claims the benefit of U.S. Provisional Application No. 61/978,378 filed on Apr. 11, 2014, the entire disclosure of which is incorporated herein by reference.

TECHNICAL FIELD

This disclosure generally relates to circuit interrupters, and more particularly relates to circuit interrupters in power distribution switchgear that have contact spring assemblies with masses.

BACKGROUND

Circuit interrupting devices function to isolate a fault condition in a power distribution system. Upon clearing of the fault condition certain types of these devices may be manually or automatically reclosed to restore the circuit. Faults in a power distribution system can occur for any number of reasons and are typically transient. Reclosing after the fault is cleared provides for quick service restoration.

A typical circuit interrupting device may include a vacuum interrupter having a stationary contact and a moving contact. During opening operations and closing operations of such vacuum interrupters, arcing and current flow through a partially opened vacuum interrupter may cause the stationary and moving contacts to weld together. Such welding increases the force required to subsequently open the vacuum interrupter. A typical circuit interrupting device may increase a mass of an insulating actuator rod or increase a spring constant of a contact spring within an actuation assembly to assist with opening such welded contacts. Although these typical circuit interrupting devices are suitable for their intended purpose, there is a need for circuit interrupters with improved performance.

Accordingly, it is desirable to provide a circuit interrupter device with a configuration designed for opening welded or partially welded vacuum interrupters. Furthermore, other desirable features and characteristics of the present invention will become apparent from the subsequent detailed description and the appended claims, taken in conjunction with the accompanying drawings and the foregoing technical field and background.

DESCRIPTION OF THE DRAWINGS

The invention, both as to its organization and method of operation, together with further objects and advantages thereof, will best be understood by reference to the specification taken in conjunction with the accompanying drawing in which.

DETAILED DESCRIPTION

Figure 1:
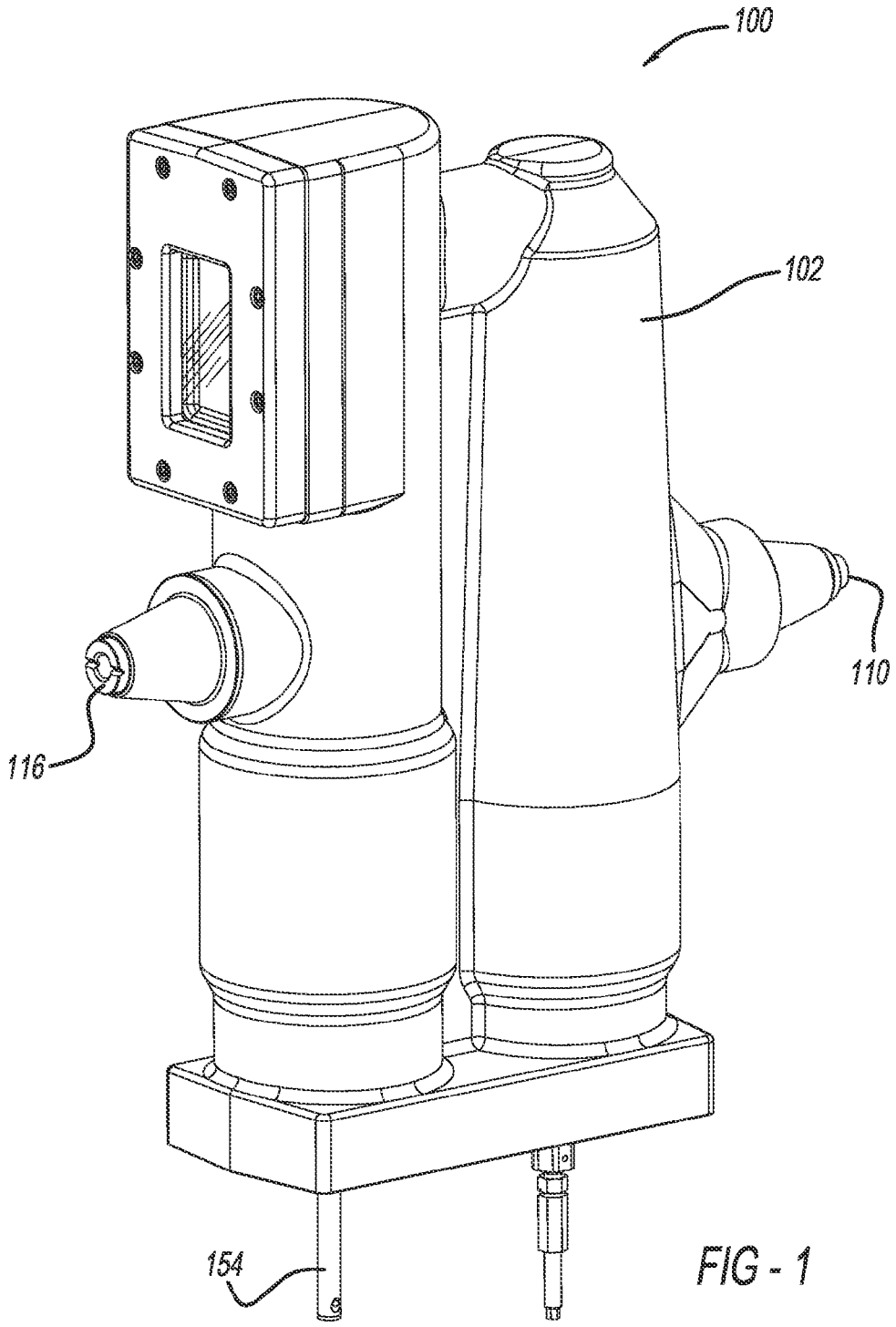
FIG. 1 is a perspective view of a circuit interrupting device in accordance with teachings of the present disclosure.

Circuit interrupting devices, circuit interrupting assemblies, and contact spring assemblies are provided. In one embodiment, a circuit interrupting device includes a circuit interrupter and a contact spring assembly. The circuit interrupter has a moving contact and a stationary contact. The circuit interrupter includes a closed position in which the stationary contact and the moving contact are in contact at an interface. The contact spring assembly includes a dielectric drive rod, a mass, and a plunger. The mass is attached to the dielectric drive rod and a distance between the mass and the interface is less than the drive rod length. The plunger is attached to the moving contact and engages with the mass in response to actuation of the dielectric drive rod.

In another embodiment, a circuit interrupter assembly includes a solid insulation housing, a first conductor, a second conductor, a vacuum interrupter, a mass, a plunger, a ferrule, a spring, and a dielectric drive rod. The solid insulation housing defines a first cavity. The first conductor is disposed in the solid insulation housing and has a first external coupling. The second conductor is disposed in the solid insulation housing and has a second external coupling. The vacuum interrupter is disposed within the first cavity and includes a moving contact and a stationary contact. The moving contact is electrically coupled with the first conductor and the stationary contact is in selectable electrical communication with the second conductor. The mass is disposed within the first cavity and has an annular shape that defines an inner bore. The inner bore has a first diameter at a first portion of the mass and a second diameter that is larger than the first diameter at a second portion of the mass. The plunger has a flange portion and a body portion. The flange portion is disposed within the inner bore at the second portion and has a flange diameter that is larger than the first diameter. The body portion is received for translation through the inner bore at the first portion and is attached to the moving contact of the vacuum interrupter. The ferrule is fastened to the inner bore of the mass and the dielectric drive rod is fastened to the ferrule. The spring is disposed within the inner bore between the plunger and the ferrule.

In another embodiment, a contact spring assembly for a circuit interrupting device includes a mass, a ferrule, a plunger, and a spring. The mass defines an inner bore. The inner bore has a first diameter at a first portion of the mass and a second diameter that is larger than the first diameter at a second portion of the mass. The ferrule is fixed to the inner bore of the mass and is configured to receive a dielectric drive rod. The plunger has a flange portion and a body portion. The flange portion is disposed within the inner bore at the second portion and has a flange diameter that is larger than the first diameter. The body portion is received for translation through the inner bore at the first portion and is configured to attach to a moving contact of the circuit interrupting device. The spring is disposed within the inner bore between the plunger and the ferrule.

Example embodiments will now be described more fully with reference to the accompanying drawings. There is no intention to be bound by any principle presented in the preceding background or the following detailed description.

Figure 2:
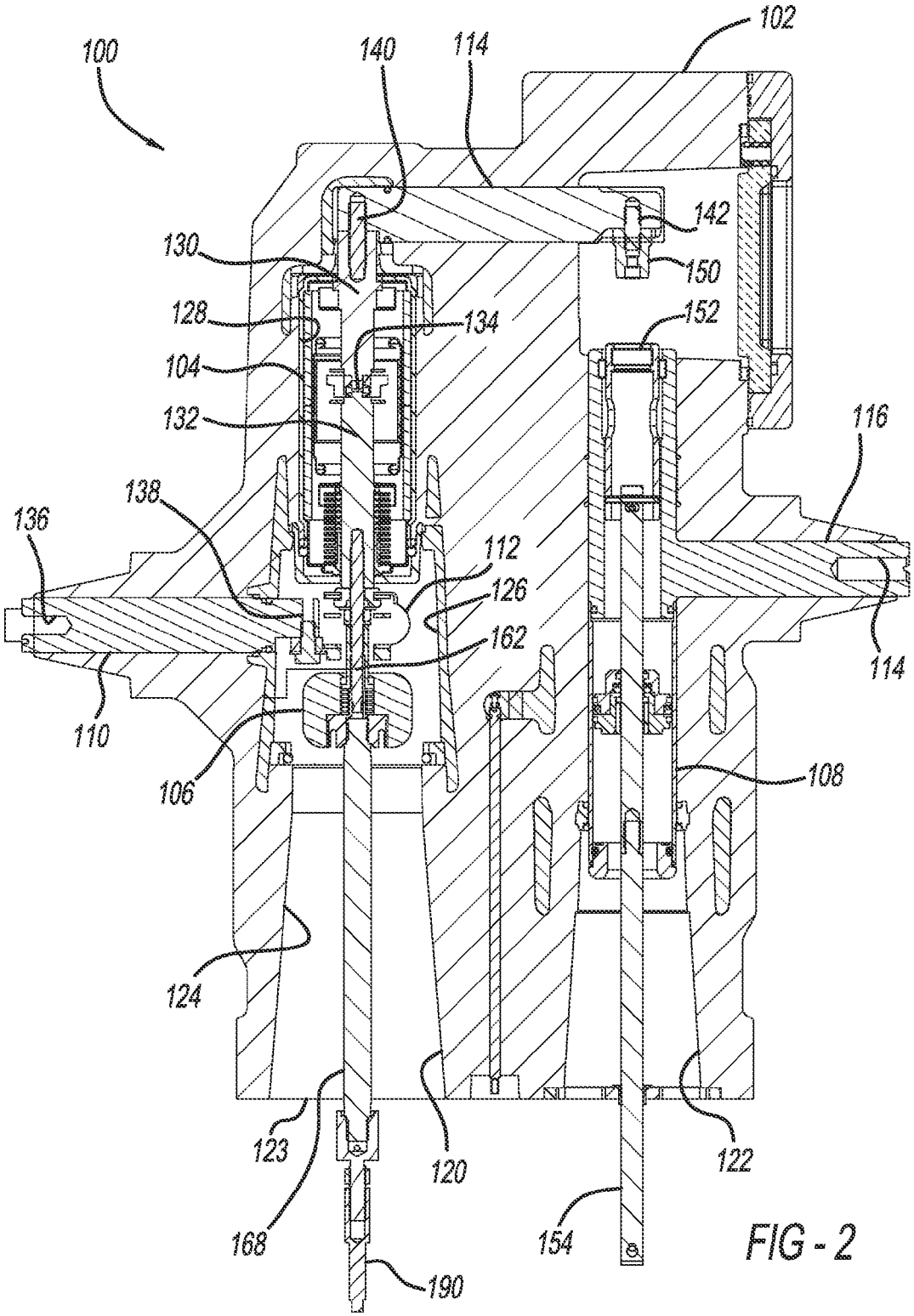
FIG. 2 is a cross-sectional view of the circuit interrupting device illustrated in FIG. 1.

FIGS. 1-2 illustrate an embodiment of a pole unit circuit interrupting device 100 typically used as switchgear in a power distribution system. In the example provided, circuit interrupting device 100 provides fault interruption for a single phase in power distribution switchgear. It is understood that additional devices would be included for three-phase power distribution. Circuit interrupting device 100 includes a solid insulation housing 102, a fast acting interrupter such as a vacuum interrupter 104, a contact spring assembly 106, a slow acting disconnect 108, a first external conductor 110, a flexible conductor 112, an internal conductor 114, and a second external conductor 116.

Solid insulation housing 102 is a molded electrically insulating material, such as plastic. Solid insulation housing 102 is molded with a first cavity 120 and a second cavity 122. First cavity 120 extends inward from an external opening 123 to a first conical portion 124, a second conical portion 126, and a cylindrical portion 128. First and second conical portions 124 and 126 surround contact spring assembly 106. In the example provided, second conical portion 126 is lined by an insulating epoxy material. First cavity 120 encloses vacuum interrupter 104 and the associated mechanical and electrical coupling components. Solid insulation housing 102 may have any suitable shape, such as cylindrical, rectangular box, or an irregular shape.

Vacuum interrupter 104 is electrically coupled between first external conductor 110 and internal conductor 114 to selectively disconnect electrical current through circuit interrupting device 100. Vacuum interrupter 104 may be secured within cylindrical portion 128 of first cavity 120 by a potting material, such as silicone or another suitable material. Vacuum interrupter 104 includes a stationary contact 130 and a moving contact 132.

Stationary contact 130 is electrically coupled with internal conductor 114, moving contact 132 is electrically coupled with flexible conductor 112, and flexible conductor 112 is electrically coupled with first external conductor 110. As will be appreciated by those with skill in the art, current flows through vacuum interrupter 104 when vacuum interrupter is in a closed position in which moving contact 132 is in contact with stationary contact 130 at an interface 134, as illustrated. Conversely, current flow through circuit interrupting device 100 is interrupted when vacuum interrupter 104 is in an open position with moving contact 132 separated from stationary contact 130. Other fault interrupters capable of interrupting the current path within a sealed enclosure and providing arc control and/or arc suppression may be used without departing from the scope of the present disclosure.

Conductors 110, 112, 114, 116, vacuum interrupter 104, and disconnect 108 define a current path through circuit interrupting device 100, as will be appreciated by those with skill in the art. In the example provided, first external conductor 110 is a conductive rod including a first tap 136 for coupling externally of the solid insulation housing 102 and a second tap 138 for fastening to flexible coupling 112. Internal conductor 114 is a conductive rod that includes a first tap 140 for fastening to stationary contact 130 and a second tap 142 for fastening to slow acting disconnect 108. Internal conductor 114 is selectively electrically coupled with first external conductor 110 by vacuum interrupter 104. Internal conductor 114 is further selectively electrically coupled with second external conductor 116 by slow acting disconnect 108. Second external conductor 116 is a conductive rod that includes a first tap 144 for coupling externally of solid insulation housing 102. In the example provided, first tap 136 and first tap 144 are threaded external couplings.

Disconnect 108 includes a stationary contact 150, a moving contact 152, and an actuation rod 154. Stationary contact 150 is fastened to internal conductor 114 at second tap 142 with a suitable fastener, such as a threaded fastener. Moving contact 152 is attached to actuation rod 154 and is in sliding engagement and is electrically coupled with second external conductor 116. Actuation rod 154 may be any insulating rod, such as a fiberglass rod. It should be appreciated that other types of slow acting disconnects 108 may be used.

Figure 3:
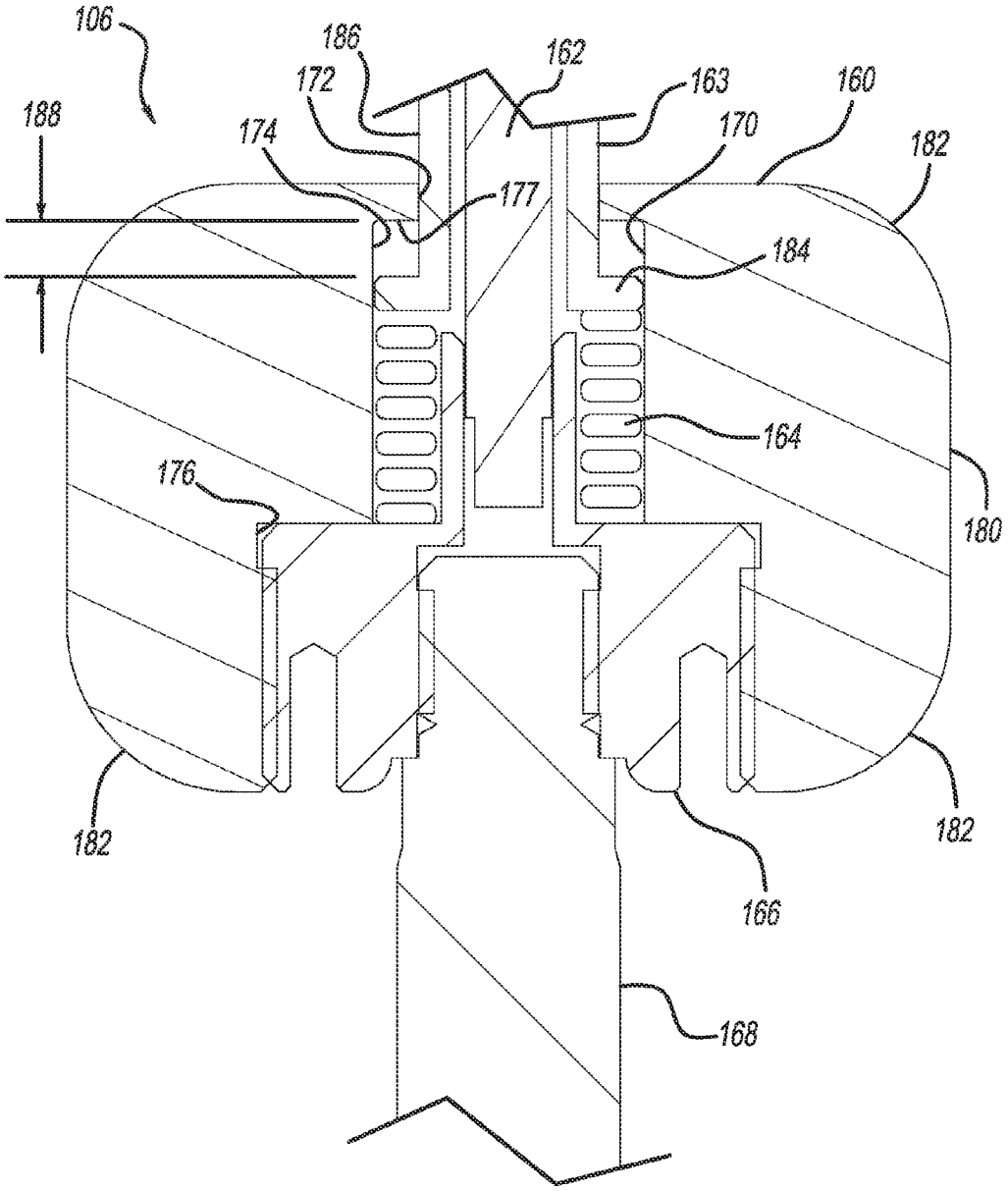
FIG. 3 illustrates a detailed cross-section of a contact spring assembly of the circuit interrupting device of FIG. 1.
Figure 4:
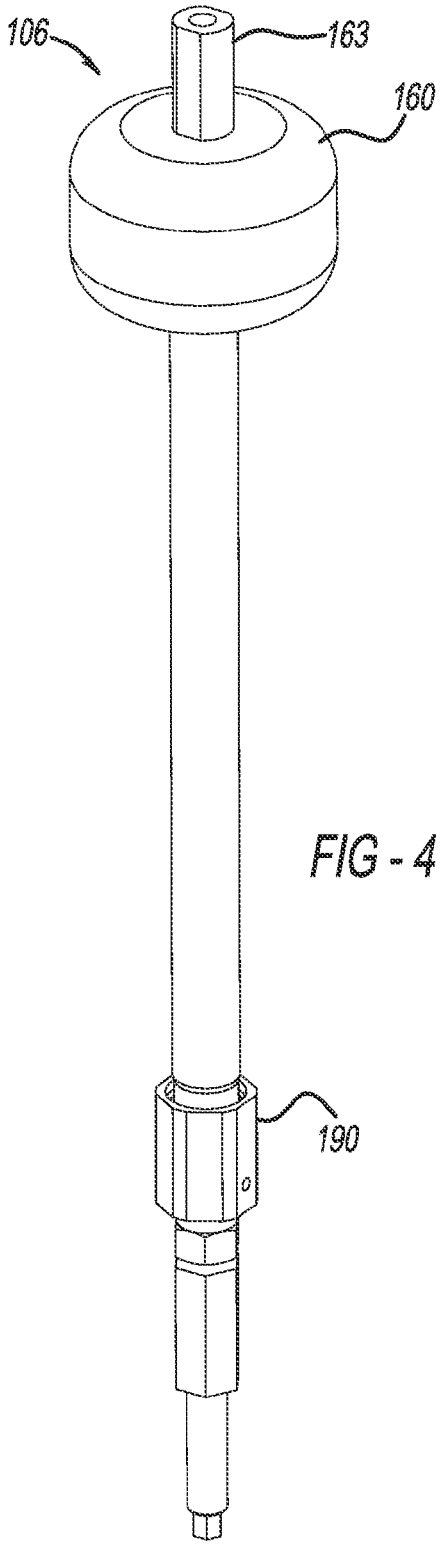
FIG. 4 illustrates an assembly view of the contact spring assembly.
Figure 5:
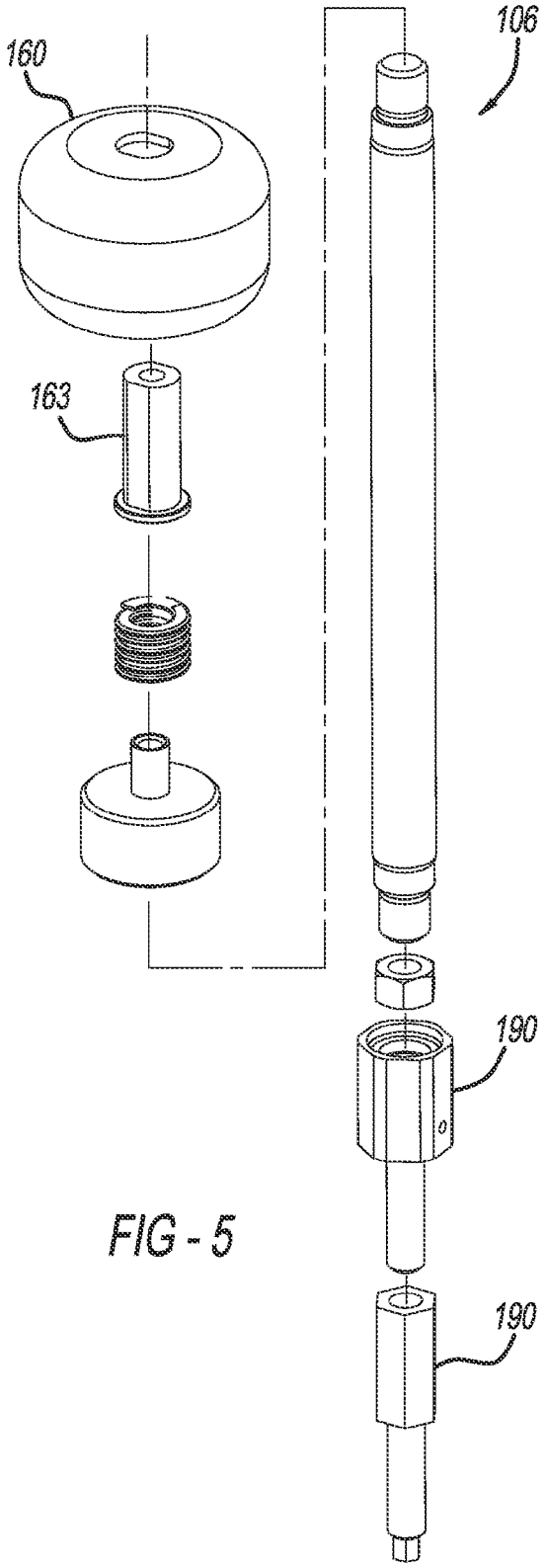
FIG. 5 illustrates an expanded view of the contact spring assembly.

Referring now to FIGS. 3-5, details of contact spring assembly 106 are illustrated in various views. Contact spring assembly 106 includes an annular mass 160, a threaded rod 162, a plunger 163, a contact spring 164, a ferrule 166, and a dielectric drive rod 168.

Annular mass 160 is a rigid mass with an annular shape that defines an inner bore 170. A metal alloy or other material may be used as the rigid material of annular mass 160. The rigid material resists deformation to quickly accelerate upon actuation of dielectric drive rod 168. The rigid material further resists reduction of impact forces due to deformation when annular mass 160 strikes plunger 163 during an opening operation of vacuum interrupter 104, as will be described below. Annular mass has a first portion 172, a second portion 174, and a third portion 176. Counter bore 170 extends through mass 160 and has a first diameter at first portion 172, a second diameter at second portion 174, and a third diameter at third portion 176. The third diameter is larger than the second diameter, which is larger than the first diameter. Portions 172, 174, and 176 are each cylindrical in shape and circumscribe at least portions of the other components of contact spring assembly 106. First portion 172 defines a striking surface 177 at the transition between the first diameter and the second diameter of bore 170 for impacting plunger 163 during opening operations of vacuum interrupter 104. In the example provided, striking surface 177 is an annulus. It should be appreciated that other shapes, such as a conical surface, may be used without departing from the scope of the present disclosure.

Annular mass 160 has a generally cylindrical outer surface 180 with rounded outer edges 182. Cylindrical outer surface 180 has an extended diameter to increase the inertial mass of annular mass 160. As used herein, an "extended diameter" means that the diameter is larger than any diameter needed for structural support of components in contact spring assembly 106. The added inertial mass from the extended diameter improves the hammer-blow effect when annular mass 160 impacts plunger 163 to assist with opening welded contacts within vacuum interrupter 104, and limits the severity of contact welding during closing operations, as will be appreciated by those with skill in the art.

Rounded outer edges 182 reduce electrical stresses that occur between components of contact spring assembly 106 that are at high voltage differential with respect to the insulating material of the dielectric drive rod 168 and housing 102. Because annular mass 160 may be at high voltage, rounded edges provide reduced concentrations of electric charge when compared with sharp edges. Therefore, rounded outer edges 182 reduce chances of dielectric breakdown of the air and arcing within first cavity 120 towards materials located outside of first cavity 120.

Annular mass 160 is disposed proximate to vacuum interrupter 104. As used herein, annular mass 160 being "proximate to" vacuum interrupter 104 means that annular mass 160 is located as close as the various connections allow to an interface between stationary contact 130 and moving contact 132. In the example provided, annular mass 160 is located closer to interface 134 than to external opening 123 of first cavity 120. Such proximity provides a beneficial mass ratio between moving contact 132 and the effective mass acting to pull open moving contact 132.

By having an enlarged and rigid amount of mass proximate to moving contact 132, impact losses may be reduced when compared to systems where masses are farther away from a moving contact. Impact losses during the opening operation can occur through a number of factors; the accumulation of joints (e.g., pin slop), the strain of its components (e.g., stretch and flexing), and the inefficient distribution of effective mass, whether rotational or linear motion. The proximity also increases the natural frequency of vibration of the components between the mass 160 and the contact interface 134, and reduces the duration of contact bounce upon closing vacuum interrupter 104. Limiting the duration of contact bounce lessens arc duration and contact separation, which leads to smaller welds with less mechanical strength. Such improved weld breaking and reduced contact bounce also permits low spring contact forces and pressures as necessary for current carrying purposes. Lower contact pressure leads to a reduction in the force a drive mechanism needs to exert on dielectric drive rod 168 to close vacuum interrupter 104. This reduction in force improves the drive mechanism reliability, reduces the 'hold close' latching force, and reduces the amount of energy needed to drive or charge the energy storage elements, as will be appreciated by those with skill in the art.

Threaded rod 162 threads into moving contact 132 and plunger 163. Flexible coupling 112 is fastened to threaded rod 162 to keep threaded rod 162 electrically coupled with first external conductor 110 during opening and closing of vacuum interrupter 104. Annular mass 160 is disposed proximate to vacuum interrupter 104 in part due to a length of threaded rod 162. In the example provided, the length of threaded rod 162 is defined by a size of flexible conductor 112 and any associated fasteners, as well as an amount of threaded rod 162 that will extend into moving contact 132 and plunger 163 when fastened. In the example provided, threaded rod 162 is received for sliding translation in ferrule 166.

Plunger 163 has a flange portion 184 and a body portion 186. Body portion 186 is attached to threaded rod 162, such as by receiving threaded rod 162 with complementary threads. Flange portion 184 is disposed within inner bore 170 at second portion 174 and has a flange diameter that is larger than the first diameter at first portion 172. Body portion 186 is received for translation through inner bore 170 at first portion 172. In the closed position of vacuum interrupter 104, flange portion 184 is separated from striking surface 177 of first portion 172 by a "lost motion" distance 188. Lost motion distance 188 is selected in part based on a spring constant of contact spring 164, and may be on the order of several millimeters. In the example provided, lost motion distance 188 is four millimeters.

Contact spring 164 is disposed within second portion 174 of inner bore 170 between plunger 163 and ferrule 166. When vacuum interrupter 104 is in the closed position, contact spring 164 is compressed by the lost motion distance 188 to bias moving contact 132 with a contact pressure. Contact pressure maintains low contact resistance and prevents contacts from separating due to the blow-off effect while accommodating high electrical current, as will be appreciated by those with skill in the art.

Ferrule 166 is fastened within inner bore 170 at third portion 176 and is configured to receive dielectric drive rod 168. For example, ferrule 166 may be threaded into third portion 176 and may receive dielectric drive rod 168 with a threaded connection.

Dielectric drive rod 168 is threaded at a first end into ferrule 166. Dielectric drive rod extends through first cavity 120 and external opening 123 to a second end on which a drive mechanism coupler 190 is attached for actuation of contact spring assembly 106. For example, drive mechanism coupler 190 may be configured to attach to a mechanical, electrical, or pneumatic actuator that is operable to pull dielectric drive rod 168 and open vacuum interrupter 104, as will be described below. In the example provided, dielectric drive rod 168 has a drive rod length that is longer than a distance between annular mass 160 and interface 134. Accordingly, dielectric drive rod 168 accommodates the location of annular mass 160 proximate to vacuum interrupter 104.

It should be appreciated that in alternative embodiments, contact spring assembly 106 may be located in other electrical contact assemblies (e.g., contactors, relays, switches) that perform closing under load duties. In other alternative embodiments, contact spring assembly 106 may be utilized in actuation of high pressure fluid valves or in work hardening presses.

During opening of vacuum interrupter 104, a drive mechanism pulls drive mechanism coupler 190 away from solid insulation housing 102. Dielectric drive rod 168 transmits the driving force from the drive mechanism to ferrule 166, which transmits the driving force to annular mass 160. Annular mass 160 accelerates away from vacuum interrupter 104 based on the driving force and a force from contact spring 164 and builds inertia as annular mass 160 travels over lost motion distance 188. When annular mass 160 has traveled lost motion distance 188, striking surface 177 of annular mass 160 impacts flange portion 184 of plunger 163. The impact provides a hammer-blow effect to plunger 163, which provides the impact force to threaded rod 162, which provides the impact force to moving contact 132. The impact force provided to moving contact 132 breaks the weld at interface 134 to open vacuum interrupter 104.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

We claim:

1. A circuit interrupting device, comprising:

a circuit interrupter having a moving contact and a stationary contact, wherein the circuit interrupter includes a closed position in which the stationary contact and the moving contact are in contact at an interface; and a contact spring assembly comprising:

a dielectric drive rod having a drive rod length, a mass attached to the dielectric drive rod, wherein a distance between the mass and the interface is less than the drive rod length, and a plunger attached to the moving contact and configured for engagement with the mass in response to actuation of the dielectric drive rod.

2. The circuit interrupting device of claim 1, wherein the plunger has a flange portion and a body portion, and wherein the flange portion opposes the mass and the body portion is engaged for sliding translation with the mass.

3. The circuit interrupting device of claim 2, wherein the mass has an annular shape that defines an inner bore, the inner bore having a first diameter at a first portion of the mass and having a second diameter that is larger than the first diameter at a second portion of the mass, and wherein the flange portion of the plunger is disposed within the inner bore at the second portion and has a flange diameter that is larger than the first diameter, and wherein the body portion of the plunger is received for translation through the inner bore at the first portion.

4. The circuit interrupting device of claim 3, wherein the flange portion of the plunger is separated from the first portion of the mass by a lost motion distance when the circuit interrupter is in the closed position.

5. The circuit interrupting device of claim 1, wherein the contact spring assembly further includes a ferrule fastened to the mass and to an end of the dielectric drive rod.

6. The circuit interrupting device of claim 5, wherein the contact spring assembly further includes a spring disposed between the plunger and the ferrule, and wherein the spring biases the moving contact against the stationary contact in the closed position of the circuit interrupter.

7. The circuit interrupting device of claim 1, further comprising:

a solid insulation housing that defines a first cavity;

a first conductor disposed in the solid insulation housing and having a first external coupling; and a second conductor disposed in the solid insulation housing and having a second external coupling, and wherein the moving contact is electrically coupled with the first conductor and the stationary contact is in selectable electrical communication with the second conductor.

8. The circuit interrupting device of claim 7, further comprising a flexible conductor electrically coupled with the first conductor and with the moving contact of the circuit interrupter.

9. The circuit interrupting device of claim 7, further comprising a disconnect electrically coupled between the stationary contact of the circuit interrupter and the second conductor.

10. The circuit interrupting device of claim 1, wherein the mass of the contact spring assembly is disposed proximate to the moving contact of the circuit interrupter.

11. The circuit interrupting device of claim 1, wherein the mass has rounded outer edges that are configured to limit concentration of electric charge.

12. The circuit interrupting device of claim 1, wherein the circuit interrupter is a vacuum interrupter.

13. The circuit interrupting device of claim 1, wherein the contact spring assembly further includes a threaded rod that is fastened to the plunger and to the moving contact of the circuit interrupter.

14. A circuit interrupter assembly, comprising:

a solid insulation housing that defines a first cavity;

a first conductor disposed in the solid insulation housing and having a first external coupling;

a second conductor disposed in the solid insulation housing and having a second external coupling;

a vacuum interrupter disposed within the first cavity and including a moving contact and a stationary contact, wherein the moving contact is electrically coupled with the first conductor and the stationary contact is in selectable electrical communication with the second conductor, wherein the vacuum interrupter includes a closed position in which the stationary contact and the moving contact are in contact at an interface;

a mass disposed within the first cavity and having an annular shape that defines an inner bore, the inner bore having a first diameter at a first portion of the mass and having a second diameter that is larger than the first diameter at a second portion of the mass, a plunger having a flange portion and a body portion, wherein the flange portion is disposed within the inner bore at the second portion and has a flange diameter that is larger than the first diameter, and wherein the body portion is received for translation through the inner bore at the first portion and is attached to the moving contact of the vacuum interrupter, and wherein the flange portion of the plunger is separated from the first portion of the mass by a lost motion distance in the closed position;

a ferrule fastened to the inner bore of the mass, a spring disposed within the inner bore between the plunger and the ferrule, and wherein the spring biases the moving contact against the stationary contact in the closed position of the vacuum interrupter, and a dielectric drive rod fastened to the ferrule and having a drive rod length that is longer than a distance between the mass and the interface.

15. The circuit interrupter assembly of claim 14, wherein the mass has rounded outer edges that are configured to limit concentration of electric charge.

16. The circuit interrupter assembly of claim 14, further comprising a disconnect electrically coupled between the stationary contact of the vacuum interrupter and the second conductor.

17. A contact spring assembly for a circuit interrupting device, the contact spring assembly comprising:

a mass defining an inner bore, the inner bore having a first diameter at a first portion of the mass and having a second diameter that is larger than the first diameter at a second portion of the mass;

a dielectric drive rod;

a ferrule fixed to the inner bore of the mass, the ferrule fastened to and configured to receive the dielectric drive rod;

a plunger having a flange portion and a body portion, wherein the flange portion is disposed within the inner bore at the second portion and has a flange diameter that is larger than the first diameter, and wherein the body portion is received for translation through the inner bore at the first portion and is configured to attach to a moving contact of the circuit interrupting device;

a threaded rod fastened to the plunger, wherein the threaded rod has a length that is less than a length of the dielectric drive rod; and a spring disposed within the inner bore between the plunger and the ferrule.

18. The contact spring assembly of claim 17, wherein the mass has rounded outer edges that are configured to limit concentration of electric charge.

* * * * *